United States Patent [19]

Showman et al.

[11] 4,390,224

[45] Jun. 28, 1983

[54] TWO PIECE ZERO INSERTION FORCE CONNECTOR

[75] Inventors: Robert L. Showman, Hershey; Robert N. Weber, Hummelstown, both of Pa.

[73] Assignee: AMP Incorporated, Harrisburg, Pa.

[21] Appl. No.: 263,661

[22] Filed: May 14, 1981

[51] Int. Cl.[3] ..... H01R 13/62

[52] U.S. Cl. ..... 339/75 MP; 339/17 LC; 339/176 MP

[58] Field of Search ..... 339/17 LC, 17 LM, 17 M, 339/75 M, 75 MP, 176 M, 176 MP

[56] References Cited

U.S. PATENT DOCUMENTS

| | | | |
|---|---|---|---|
| 3,397,381 | 8/1968 | Gilissen | 339/176 MP |
| 3,533,045 | 10/1970 | Henschen | 339/17 L |
| 3,594,698 | 7/1971 | Anhalt | 339/75 M |
| 3,651,444 | 3/1972 | Desso et al. | 339/17 L |
| 3,899,234 | 8/1975 | Yeager et al. | 339/75 MP |
| 3,977,749 | 8/1976 | Langenbach | 339/75 M |
| 4,017,138 | 4/1977 | Evans | 339/75 MP |
| 4,314,736 | 2/1982 | Demnianiuk | 339/75 MP |

FOREIGN PATENT DOCUMENTS

| | | | |
|---|---|---|---|
| 3008841 | 9/1980 | Fed. Rep. of Germany | 339/75 M |
| 2305095 | 11/1976 | France | 339/75 MP |
| 530379 | 11/1976 | U.S.S.R. | 339/75 M |

*Primary Examiner*—John McQuade
*Assistant Examiner*—Gary F. Paumen
*Attorney, Agent, or Firm*—Russell J. Egan

[57] ABSTRACT

A two-piece connector is disclosed for making zero insertion force interconnection between a mother board and a daughter board. The connector includes a plug mounted on the daughter board and a receptacle mounted on the mother board. A linear moving cam means acts on terminals carried by the receptacle to drive them normal to the elongated axis of the receptacle. When the receptacle terminals are opened by the cam means, the plug can be inserted into the receptacle either in a normal abutting fashion or end insertion by being moved laterally into the receptacle from one end. The terminals in the receptacle each have a blade which serves as the mating portion. The terminals carried by the plug each have a pair of closely spaced tines forming a pocket therebetween which receives a mating blade therein. The subject connector system is particularly useable for effecting a high density array interconnection between mother/daughter boards.

17 Claims, 8 Drawing Figures

TWO PIECE ZERO INSERTION FORCE CONNECTOR

BACKGROUND OF THE INVENTION

1. The Field of the Invention

The present invention relates to a mother/daughter board two piece connector and in particular to a connector which can be mated in the normal direct manner or by sliding in from one end with substantially no insertion force in either case.

2. The Prior Art

These are generally two groups of connection systems used for effecting interconnect between a mother board and a daughter board. One type would be a straight edge board connector such as that disclosed in U.S. Pat. Nos. 3,397,381 or 3,533,045. This would be a generally referred to as a one piece connector since there is nothing added to the daughter board which is required to effect the interconnection. The second type of interconnection system would be a two piece connection system such as that disclosed in U.S. Pat. No. 3,651,444. In a two piece system there is a component of the connector secured to each of the circuit boards which are to be interconnected. The present connector system refers to the latter type and constitutes an improvement over the known prior art devices.

SUMMARY OF THE INVENTION

The present invention concerns a two piece interconnection system for making a zero insertion force interconnection between a mother circuit board and a daughter circuit board. The subject connector system includes a receptacle assembly which is secured to the mother board and a plug assembly which is secured to the daughter board and received in the receptacle assembly. The receptacle assembly includes a housing having a plug receiving cavity, a plurality of terminals mounted in at least one row on at least one side of the cavity, and a cam assembly adapted to act on the terminals to move them in a direction normal to the longitudinal axis of the cavity. The plug assembly includes a plurality of terminals mounted in a housing which is profiled to be received in the cavity. Each of the terminals in the plug assembly have a portion formed by tines folded upon themselves to form a pocket therebetween which receives therein a blade like portion of a respective terminal of the receptacle assembly.

It is therefore an object of the present invention to produce a two piece interconnect system for effecting a zero insertion force interconnection between a mother circuit board and a daughter circuit board.

It is another object of the present invention to produce a two piece zero insertion force interconnect system in which the members can be mated directly into one another or by sliding the members transversely with respect to each other.

It is a further object of the present invention to produce an improved zero insertion force connector system having a linear acting cam means serving to spread and return terminals of a receptacle portion so as to allow mating of a plug portion in the spread condition and contacting of the respective terminals in the closed condition.

It is yet another object of the present invention to produce a two piece zero insertion force connector which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
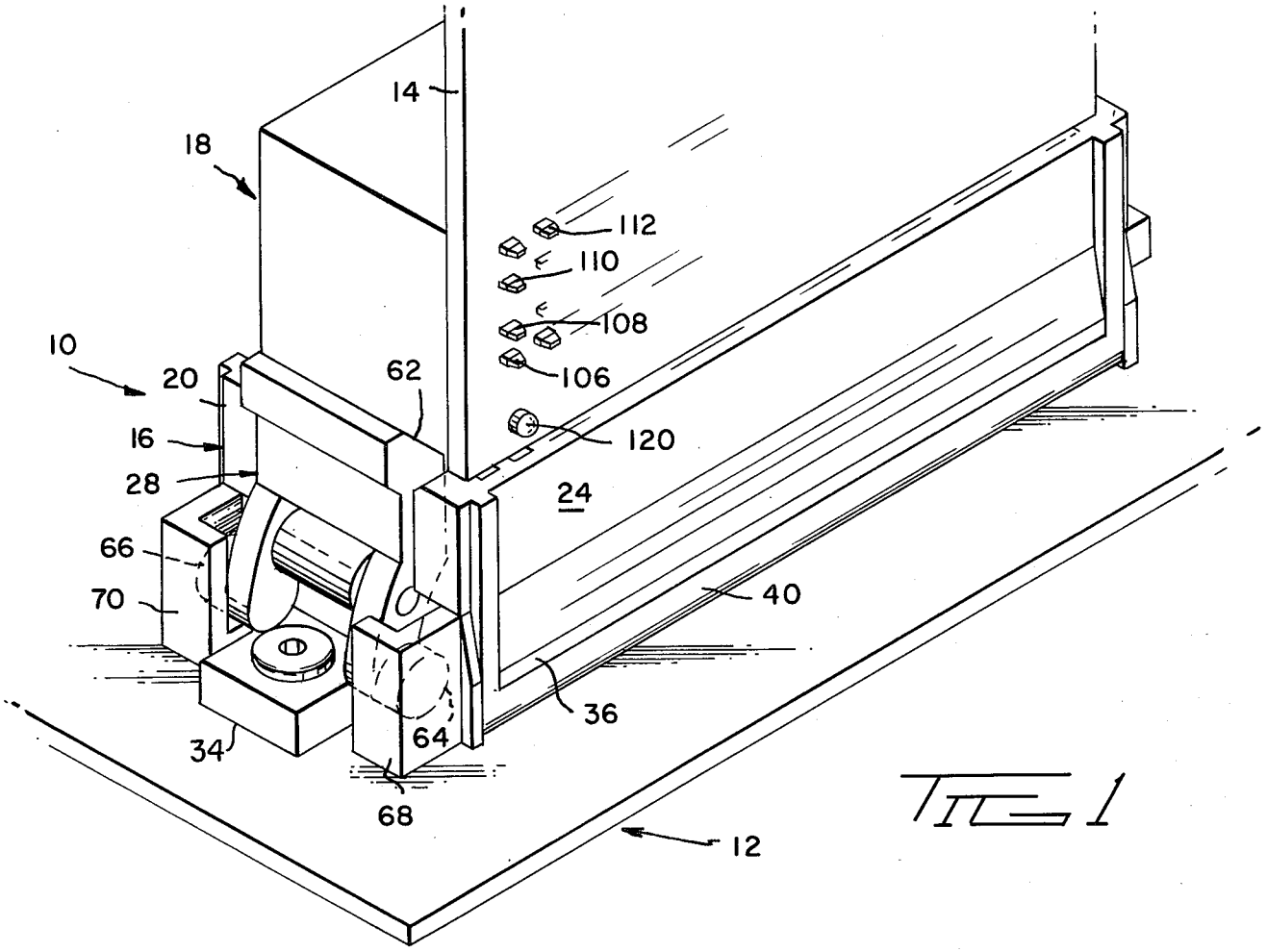
FIG. 1 is a perspective view of a two piece zero insertion force interconnect system according to the present invention.

The subject connector system 10 is intended to mate a mother board 12 with a daughter board 14. The connector system includes a receptacle assembly 16 secured to the mother board 12 and a plug assembly 18 secured to the daugther board 14. The receptacle assembly 16 includes a housing 20, formed by base 22 and cover 24, enclosing a plurality of first blade terminals 26, a cam assembly 28, and cam follower 30, 32. The base or lower housing half 22 has mounting flanges 34 integral with and extending from the opposite ends. It also has latching lugs 36, 38 along the elongated sides. The cover or upper housing half 24 is secured to the base 22 by latches 40, 42. The cover 24 defines a receptacle cavity 44, which is open at at least one end, and a plurality of terminal channels 46, 48. The base 22 defines a like plurality of terminal channels 50, 52. Together the base 22 and cover 24 define a first elongated cavity 54 in which the cam 58 of the cam assembly slides and a second adjacent cavity 56 in which the followers 30, 32 slide. The cam assembly 28 includes the elongated planar cam member 58 having a plurality of profiled apertures 60 therein in a spaced array and an actuating lever 62 pivotally mounted on one end of the cam member 58. The lever 62 includes lateral arms 64, 66 which engage in integral brackets 68, 70 of the housing base. A rotary movement of lever 60 effects a lateral movement of the cam member 58 in cavity 54 and a transverse movement of the cam followers 30, 32 in cavity 56. The cam followers 30, 32 each have a plurality of terminal passages 72, 74, 76, 78 and lugs 80, which engage in respective apertures 60 of the cam member 58. The receptacle assembly also includes a plurality of first blade terminals 26 each of which has a mounting tail 82 adopted to be attached to the mother board 12. Each terminal also includes a mounting lance 84 and a cam follower engaging intermediate portion 86. On the free end of each terminal, there is a mating blade 88 extending in the direction of movement of the terminal, that is, normal to the elongated axis of the connector.

Figure 3:
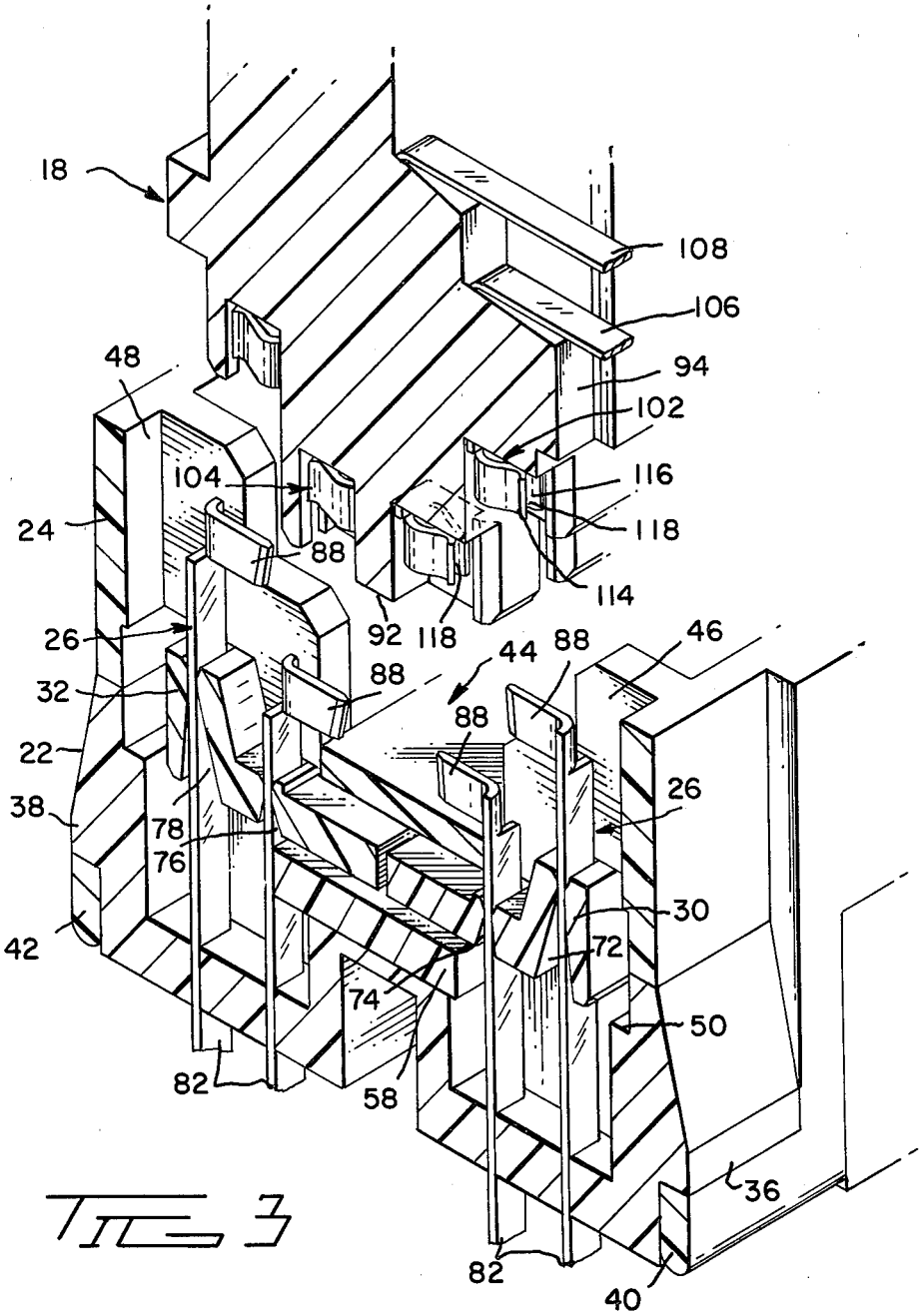
FIG. 3 is a perspective view, partly in section, of the subject connector system in an unmated condition.

The plug assembly 18 has an integral housing 90 with a mating face 92 profiled to be received in the cavity 44 and a second face 94 adopted to be mounted against the daughter board 14. A plurality of terminal passages 96, 98, 100, 102 extend from the mating face 92 to face 94. A plurality of second terminals 104 are each mounted in a respective passages 96, 98, 100, 102. Each second terminal 104 has a mounting tail 106, 108, 110, 112 each of which is of proper length to be secured to the daughter board 14. The opposite end of each terminal 104 has a pair of spaced arms 114, 116 (see FIG. 3) defining a slot 118 therebetween. The housing 90 has at least one mounting stud 120 for securing the plug assembly to the daughter board.

The receptacle assembly 16 is formed by first pinning the lever 62 to the cam member 58. This cam assembly 28 is then placed in cam cavity 54. The cam followers 30, 32 are placed into the follower cavity 56 with the lugs 80 engaging in the respective cam apertures 60. There is a choice here. Either the first terminals 26 can be preloaded into the cam followers and assembled into the housing base as respective units or the teriminals 26 can be inserted into the cam followers and base after the followers and base are assembled. The cover 24 is fitted onto the assembly and secured in place by engaging latches 40, 42 with the respective lugs 36, 38.

The plug assembly 18 is formed by simply inserting the second terminals 104 into the respective passages 96, 98, 100, 102 and bending the tails 106, 108, 110, 112 to lie at right angles to the respective passages.

The receptacle assembly 16 and plug assembly 18 are mounted on the mother board 12 and daughter board 14, respectively, in conventional fashion. The terminals 26, 104 would be secured to conductive circuits of the respective boards by wave soldering or the like. Additional securing means (not shown) could be applied to the mounting flange 34 and lug 120 as desired.

Figure 4:
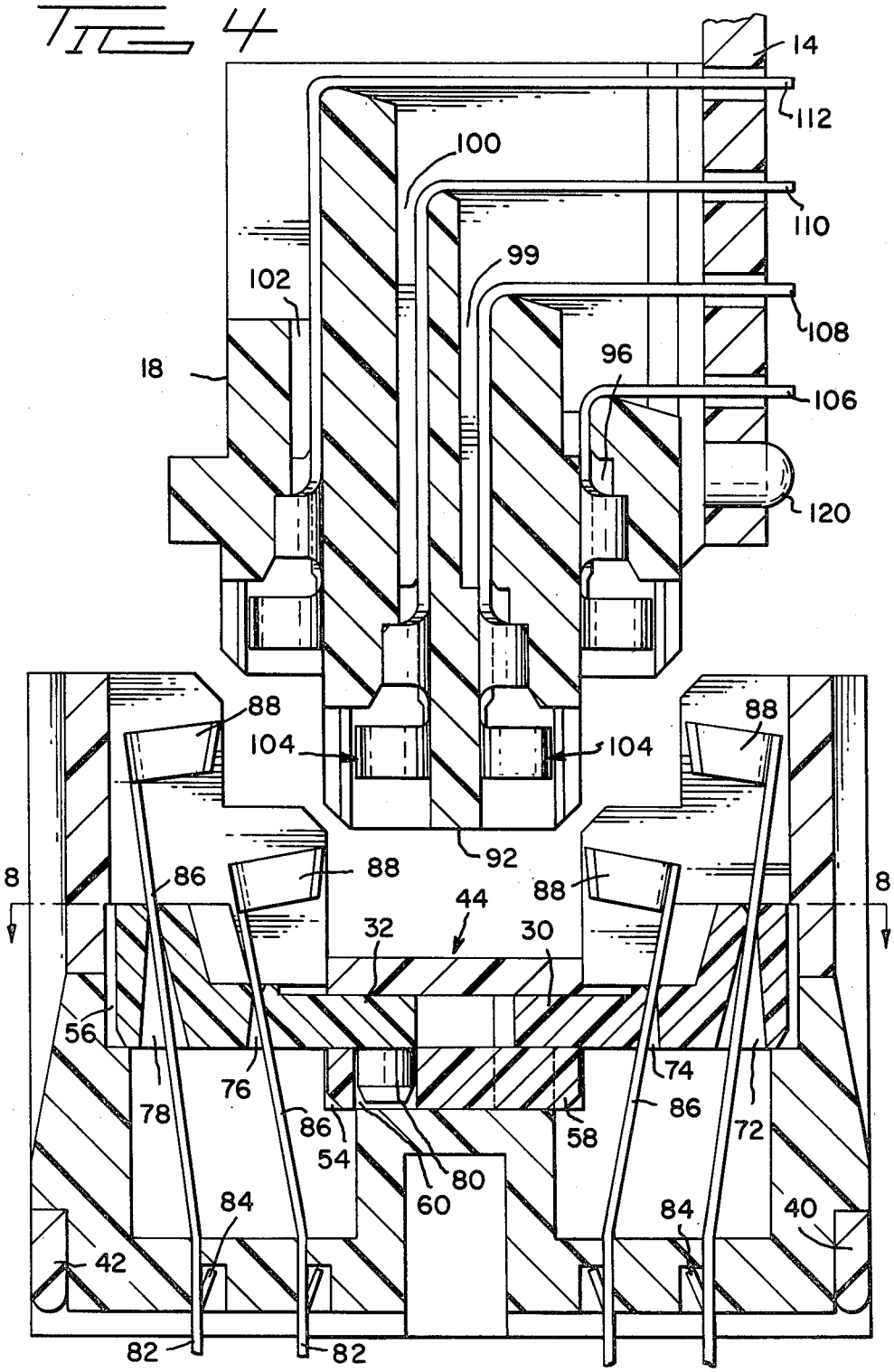
FIG. 4 is a transverse section through the subject connector system in the unmated condition of FIG. 3.
Figure 5:
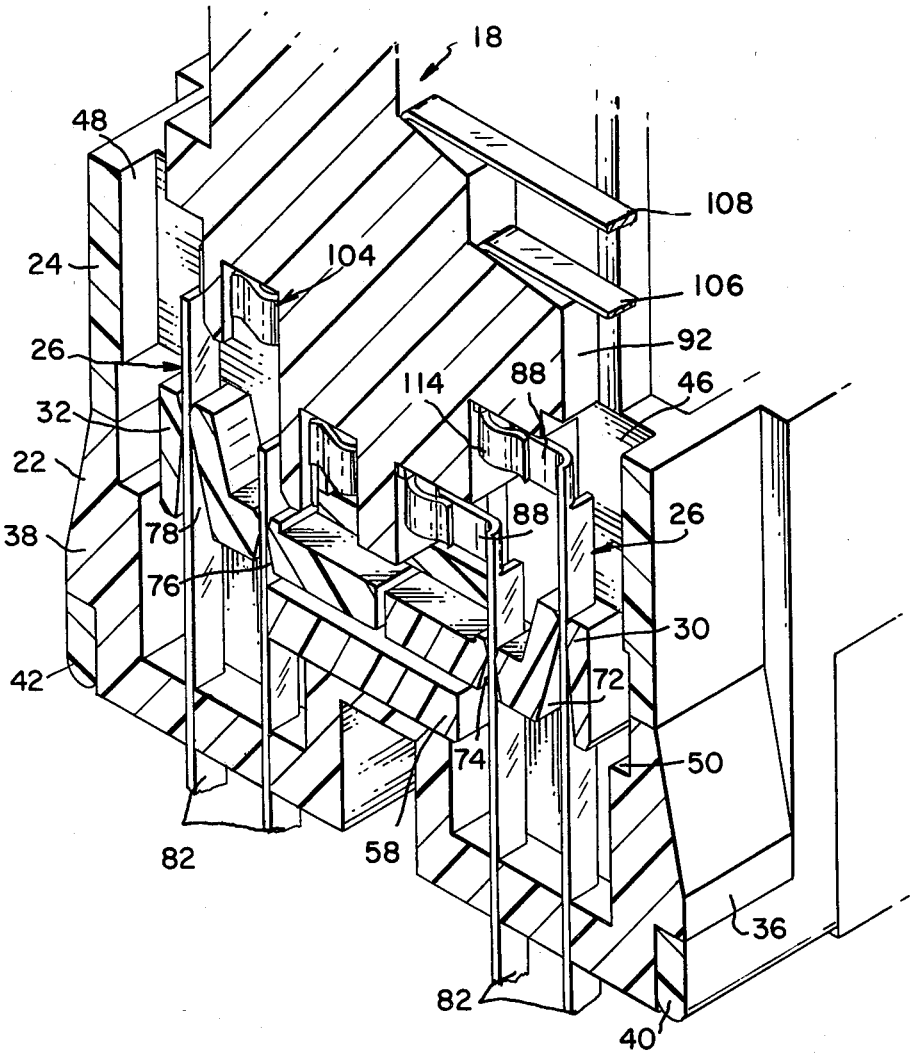
FIG. 5 is a perspective view, partly in section, showing the subject connector system in a mated condition.
Figure 6:
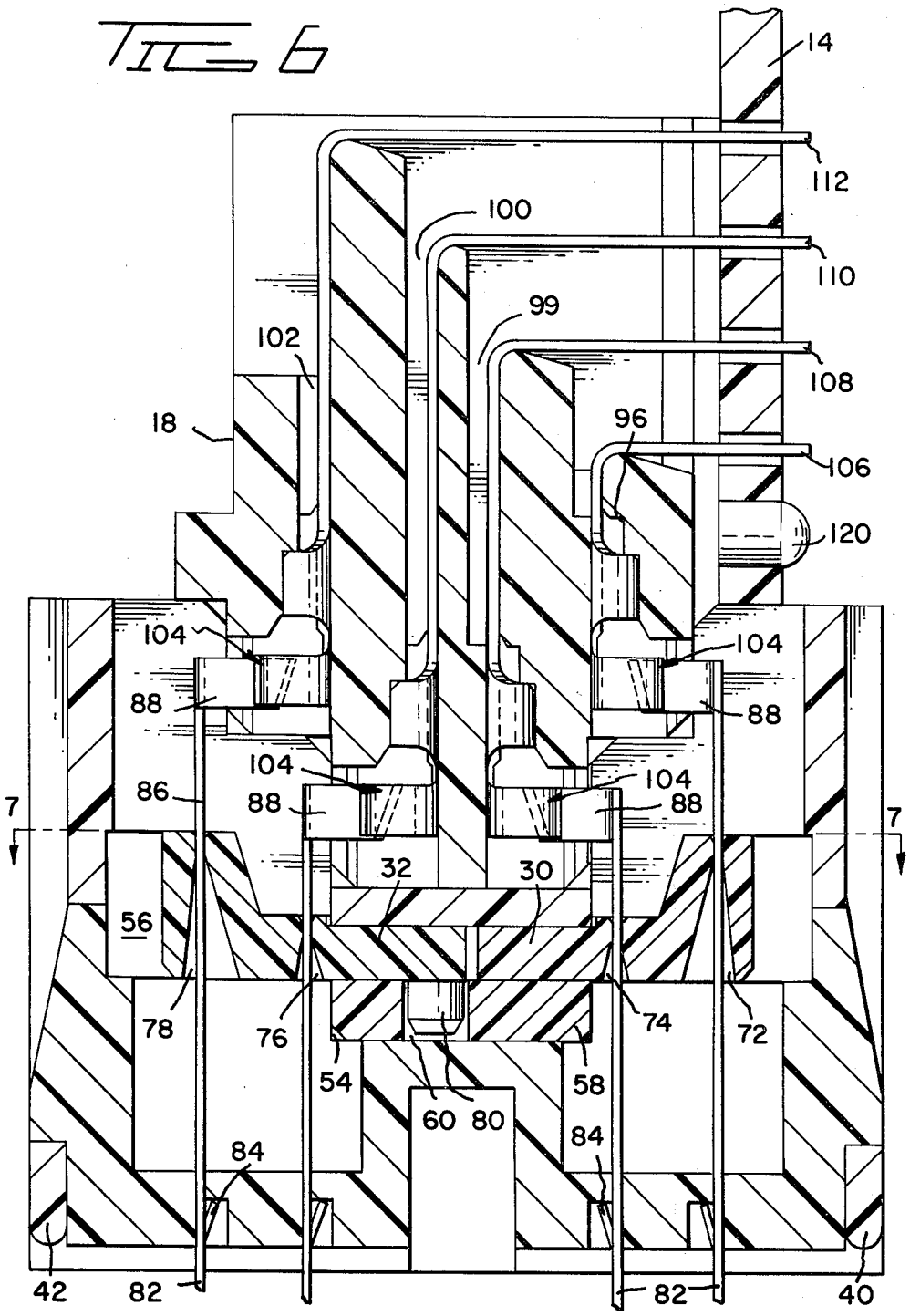
FIG. 6 is a transverse section through the subject connector system in the mated condition of FIG. 5.
Figure 7:
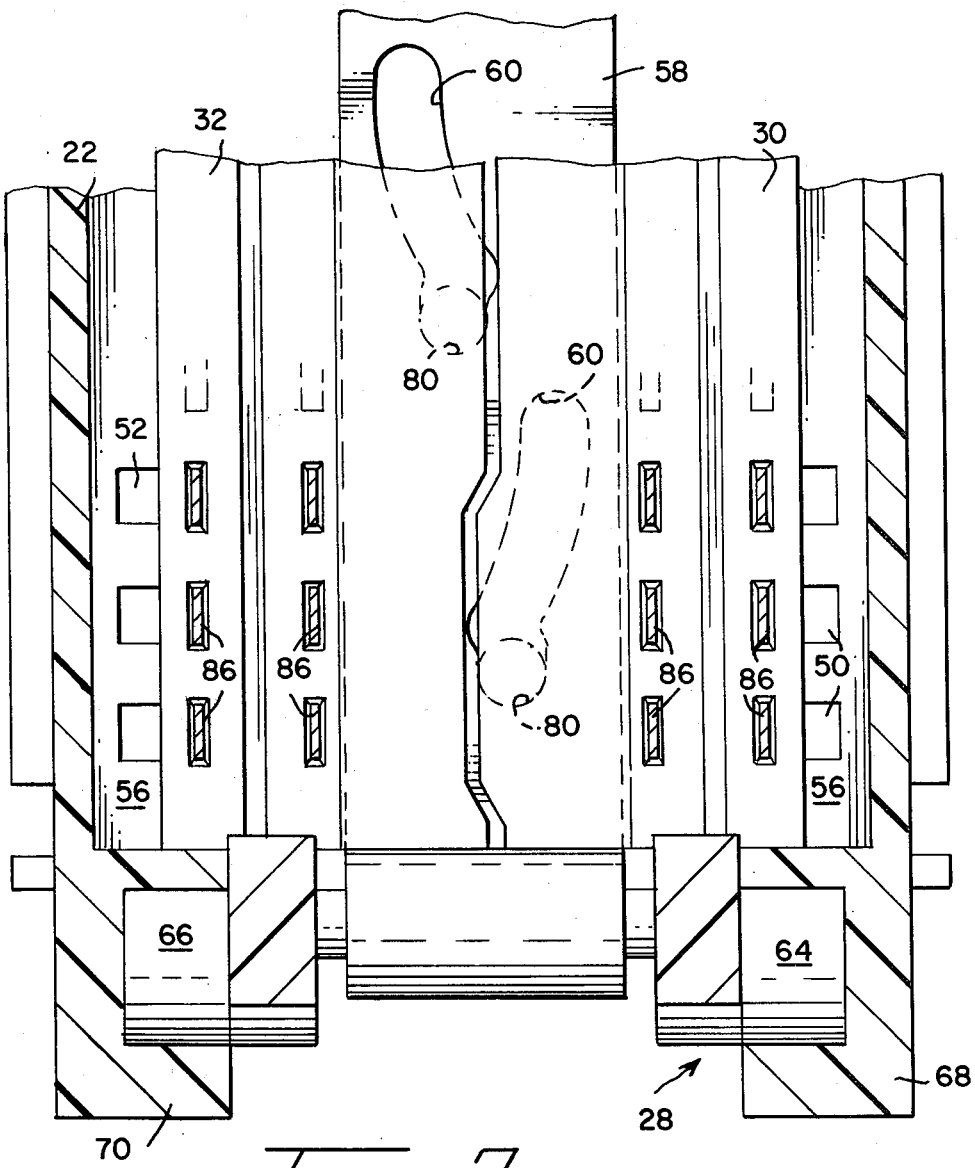
FIG. 7 is an instantaneous section taken along line 7—7 of FIG. 6 showing the cam in the closed or mated condition.
Figure 8:
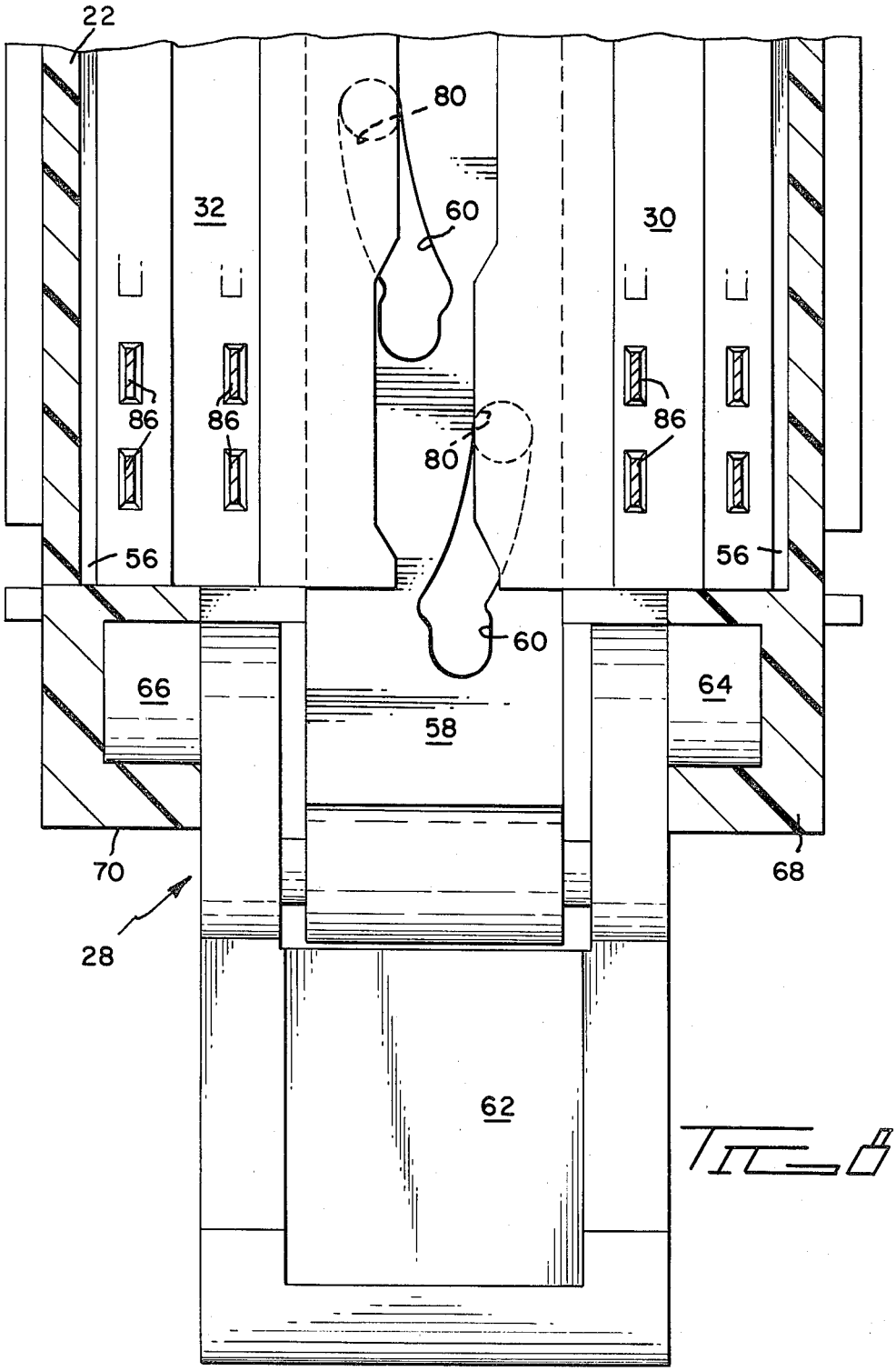
FIG. 8 is an instantaneous section taken along line 8—8 of FIG. 4 showing the cam in an open or unmated condition.

In operation the cam assembly 28 is moved to the position shown in FIGS. 4 and 8 to spread the first terminals 26 apart. The mating plug assembly on a daughter board can then be inserted into the receptacle assembly either in the direction shown in the Figures, i.e., normal to the longitudinal axis of the connector or moved longitudinally of the connector from the open end of the base and slid along its length until it is properly positioned. The terminals 28, 104 are engaged by rotating the lever 62 to drive the cam 58 to the position shown in FIGS. 6 and 7. This drives the blades 88 of first terminal 26 into the slots 118 to be engaged from opposite sides by the arms 114, 116 of the terminals 104. The rotation of lever 62 also closes the end of the receptacle assembly preventing removal of the daughter board.

Figure 2:
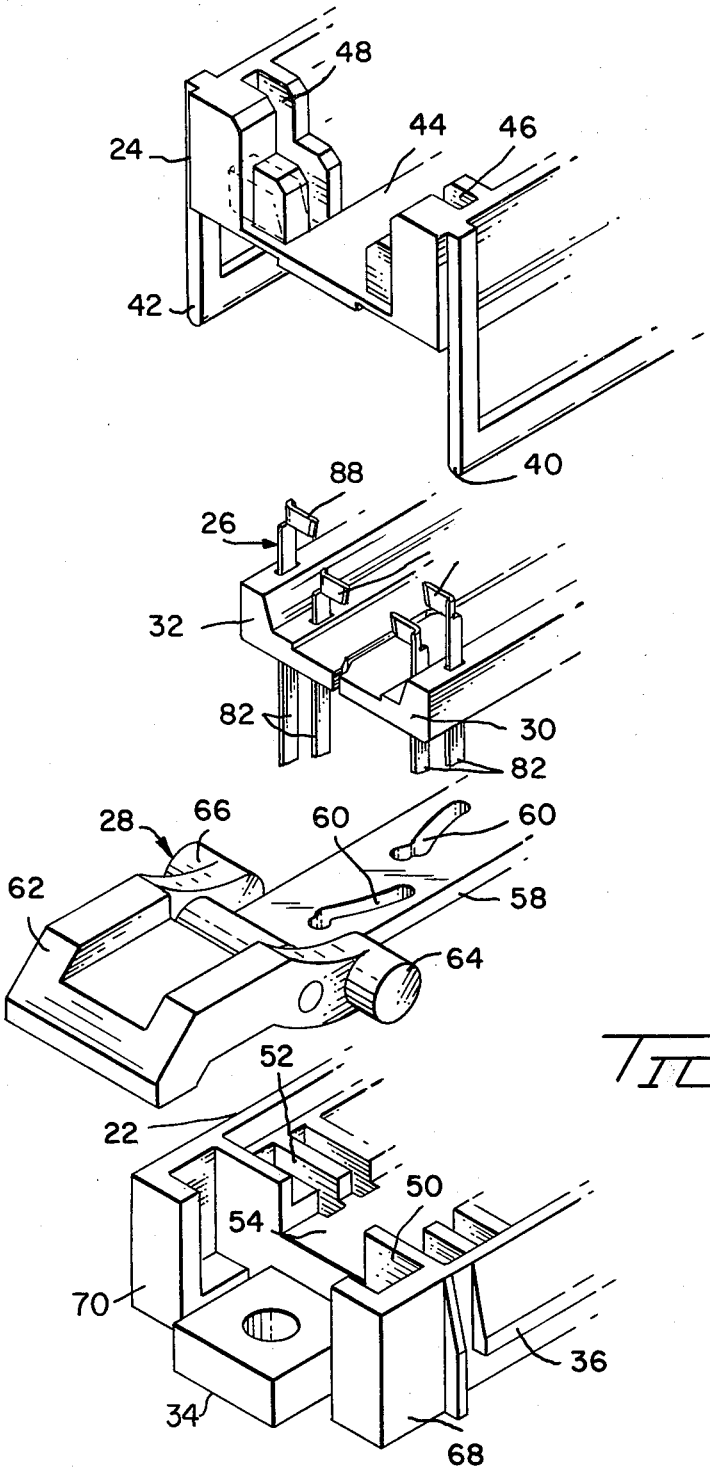
FIG. 2 is an exploded perspective view of one end of the receptacle portion of the subject interconnect system.

In order to remove the daughter board, it is first necessary to rotate lever 62 to the position shown in FIGS. 2 and 8 spreading the terminals 26, as shown in FIG. 4, and enabling removal of the daughter board.

It should be noted that the cam-follower arrangement of this system can provide back-wipe of the terminals after they are mated. Also the terminals are so profiled as to enable economic plating of only the contacting areas.

The present invention may be subject to many modifications and changes without departing from the spirit or essential characteristics thereof. The present embodiment should therefore be considered in all respects as illustrative and not restrictive of the scope of the invention.

What is claimed is:

1. A zero insertion force connector assembly for mounting daughter circuit boards on mother circuit boards comprising:

a receptacle having a housing defining an elongated cavity and a cam assembly movably mounted in a base portion of said cavity, a plurality of holes formed in said cam assembly in a patterned array, and a like plurality of first terminals mounted in said housing along at least one side of said cavity and extending through said holes in said cam assembly to be moved thereby in a direction normal to the longitudinal axis of said cavity, each said first terminal having a blade portion extending toward said cavity and a tail portion engaging said mother board; and a plug having a housing with a mating profile receivable in said cavity, a plurality of second terminals mounted in said plug housing, each said second terminal having a pair of arms defining a blade receiving slot therebetween, whereby when said plug is received in said cavity of said receptacle said first terminals are moved by said cam assembly so that the blade portions of each first terminal lies between and in engagement with said arms of a respective second terminal.

2. A zero insertion force connector assembly according to claim 1 further comprising:

means on said receptacle housing for mounting it on said mother board.

3. A zero insertion force connector assembly according to claim 1 wherein said receptacle housing comprises:

a base member having means for mounting on said mother board; and a cover member having an elongated slot forming said cavity.

4. A zero insertion force connector assembly according to claim 3 further comprising:

latching means on said base member and said cover member to secure said receptacle housing together in an assembled condition.

5. A zero insertion force connector assembly according to claim 3 wherein said base member and said cover member together define between them an elongated slot in which said cam assembly moves.

6. A zero insertion force connector according to claim 1 wherein said cam assembly comprises:

a cam member mounted for movement along the longitudinal axis of said housing, and at least one cam follower connected to said cam member so as to move normal to the longitudinal axis of said housing in response to said longitudinal movement of said cam member.

7. A zero insertion force connector according to claim 6 wherein:

said patterned array of holes is formed in said at least one cam follower.

8. A zero insertion force connector according to claim 1 wherein each said first terminal has said blade portion at one end, said tail portion at the opposite end and an intermediate portion profiled for passage through said holes in said cam assembly.

9. A zero insertion force connector according to claim 1 wherein said plug housing has:

said mating profile extending in a first direction, a daughter board engaging surface extending in a second direction, and a plurality of second terminal passages extending between said mating profile and said daughter board engaging surface.

10. A zero insertion force connector according to claim 9 further comprising:

means to mount said plug housing on said daughter board.

11. A zero insertion force connector according to claim 1 wherein said second terminal has:

said pair of arms defining a blade receiving slot lying adjacent said mating profile, and a tail portion extending from said plug having to interconnect with said daughter board.

12. A zero insertion force connector according to claim 1 wherein:

said first terminals are aligned in at least one row on at least one side of said cavity, and said second terminals are aligned in at least one row on at least one side of said plug housing positioned to matingly receive blade portions of respective first terminals.

13. A two piece zero insertion force connector assembly for making mother board/daughter board interconnection comprising:

a receptacle adapted to be mounted on said mother board, said receptacle having top and bottom elongated mating housing members defining therebetween a guide slot extending substantially parallel to and spaced from said mother board, said top housing member defining an elongated cavity, means on said bottom housing member for mounting on said mother board, a cam assembly mounted for movement in said guide slot, a plurality of profiled apertures in said cam assembly in a patterned array, means for moving said cam assembly longitudinally with respect to said housing members, a like plurality of first terminals mounted in said receptacle along at least one side of said cavity and extending through said apertures in said cam assembly to be moved thereby in a direction normal to the longitudinal axis of said cavity, each said terminal having a blade extending toward said cavity; and a plug adapted to be mounted on said daughter board, said plug having a housing defining a like plurality of terminal passages extending between a mating face and a board engaging surface, a plurality of second terminals each mounted in a respective one of said passages, each said second terminal having a pair of spaced arms defining a blade receiving slot therebetween whereby prior to mating said first terminals are spread out of said cavity by action of said cam assembly, said plug mated into said receptacle and first terminal blades driven into said second terminal slots by action of said cam assembly.

14. A two piece zero insertion force connector assembly according to claim 13 wherein said cam assembly comprises:

a cam member mounted for movement along the longitudinal axis of said receptacle, and at least one cam follower having said profiled apertures therein and connected to said cam member to move normal to said longitudinal axis of said receptacle in response to the movement of said cam member therealong.

15. A two piece zero insertion force connector assembly according to claim 14 wherein said means for moving said cam assembly comprises:

lever means connected to one end of said bottom housing member and to said cam member.

16. A two piece zero insertion force connector assembly according to claim 13 wherein said top housing member is open at one end providing access to said cavity whereby said plug can be slid longitudinally into said receptacle from said one end.

17. A two piece zero insertion force connector assembly according to claim 13 wherein each said first terminal comprises:

said blade on one end directed toward said cavity, an intermediate portion profiled to pass through a respective one of said apertures, and a tail portion on the opposite end adapted to engage said mother circuit board.

* * * * *